United States Patent [19]

Krammer-Herbst

[11] Patent Number: 5,065,536

[45] Date of Patent: Nov. 19, 1991

[54] STRETCH FRAME FOR A STRETCH BED SHEET

[76] Inventor: Maria Krammer-Herbst, Rebaystrasse 18, 8870 Günzburg, Fed. Rep. of Germany

[21] Appl. No.: 498,032

[22] Filed: Mar. 23, 1990

[30] Foreign Application Priority Data

Mar. 25, 1989 [DE] Fed. Rep. of Germany ..... 3909934

[51] Int. Cl.[5] ..... D06C 5/00

[52] U.S. Cl. ..... 38/102.91; 38/102; 38/102.4; 38/102.1

[58] Field of Search ..... 38/102–102.91, 38/12, 64, 70, 142; 223/38, 71, 120; 270/37, 38, 39; 271/188

[56] References Cited

U.S. PATENT DOCUMENTS

| | | | |
|---|---|---|---|
| 988,554 | 4/1911 | Donnell et al. | 38/102.8 |
| 1,059,112 | 4/1952 | Buckreis | 38/102.5 |
| 1,942,821 | 1/1934 | Kulp | 38/102.3 |
| 2,290,220 | 7/1942 | Wade | 38/102.4 |
| 2,598,585 | 5/1952 | Miner | 38/102.8 |

FOREIGN PATENT DOCUMENTS

| | | | |
|---|---|---|---|
| 0594412 | 9/1925 | France | 38/102 |
| 0016332 | of 1892 | United Kingdom | 38/102 |
| 0024250 | of 1901 | United Kingdom | 38/102 |

*Primary Examiner*—Werner H. Schroeder
*Assistant Examiner*—Ismael Izaguirre
*Attorney, Agent, or Firm*—Juettner Pyle & Lloyd

[57] ABSTRACT

A frame is provided to conveniently hold and store a contoured stretch sheet having pretensioned elastic at the ends and corners. After folding the sheet with the ends together, the ends are stretched around one end of the frame and the sheet is connected the other end of the frame at the fold line. The frame has central joints to allow subsequent lengthwise folding and storing of the sheet.

6 Claims, 1 Drawing Sheet

STRETCH FRAME FOR A STRETCH BED SHEET

BACKGROUND OF THE INVENTION

This invention relates to a stretch frame for a stretch bed sheet.

Stretch bed sheets are increasingly used because they can quickly and easily be fastened to mattresses and are always held in a perfect, entirely smooth position during their use, so that they need not be smoothed again every day as is the case with conventional bed sheets which are folded over mattresses.

For stretching a stretch bed sheet on a mattress, the bed sheet is provided with a bordered edge which encloses the lateral edges of the mattress and is rounded in the corner portions; an elastic tape which is sewn into the edge and stretches the bed sheet on the underside of the mattress normally extends along the two short sides of the stretch bed sheet from one corner portion to the other one.

In the non-stretched state the prestretched sewn-in elastic bands draw together the stretch bed sheet in the area of the two narrow sides, so that it is impossible to fold the bed sheet smoothly. Hence, when the stretch bed sheet is folded several times for storing the same in a linen shelf of a press, or the like the result is, an untidy, crumpled arrangement which is not only unsightly, but also takes up additional space, even when great care is taken. When the resilience of the elastic bands decreases, the folding; which is bound to be disorderly, has the additional disadvantage that the resultant wrinkles in the bed sheet are no longer fully smoothed out.

Hence, there is an urgent need for a device by means of which a stretch bed sheet can be folded without wrinkles.

It is therefore the object of the present invention to provide such a device.

SUMMARY OF THE INVENTION

This object is attained by the invention through the features specified herein. Advantageous developments of the invention are characterized in the subclaims.

The present invention comprises a substantially U-shaped stretch frame to which the stretch bed sheet is fastened. The U-shaped frame has two parallel long legs which are at right angles with a short connection leg parallel to which another short leg extends in hairpin-like fashion, i.e. at a small distance over the entire length therof, in a plane extending in a direction perpendicular to the plane of the U-shaped frame. The two long legs and the hairpin-like short legs have dimensions which substantially correspond to half the length and half the width of an associated stretch bed sheet, and the long legs are provided at about their middle with joints by means of which the frame can be collapsed to about half its size. Furthermore, the long legs are provided in the area of their free ends with clamping means, with the aid of which the stretch bed sheet, can be detachably fastened to the frame.

For the unwrinkled folding of the stretch bed sheet, the same is first folded around its center line parallel to the short sides, the elasticated edge border of the one narrow side being inserted into the corresponding border of the other narrow side. In this state the bed sheet is reduced to half its size and has a doubled, elasticated bordered edge opposite to which a smooth-folded edge is located. The bordered edge is now stretched over the two hairpin-like short legs of the stretch frame; apart from the bordered edge, the bed sheet is now smoothed in the same way as if it were stretched on a mattress. The elasticated bordered edge surrounds the two hairpin-like legs and is located—invisibly to the outside—inside the smoothed-out surfaces of the stretch bed sheet.

The now double-folded stretch bed sheet, which is reduced to a quarter of its original surface area, extends without any wrinkles from the edge portion smoothed on the hairpin-like legs to the lower end of the two parallel long legs where the edge portion of the stretch bed sheet is fastened with the aid of suitable clamping means. Subsequently, the stretch frame is once again collapsed at about its center, whereby the stretch bed sheet is folded in a perfectly smoothed-out way to a size which allows its easy storing.

The stretch bed sheet can be folded quickly and easily in the above-described way. In the folded unwrinkled state the stretch bed sheet takes up considerably less space than a conventionally folded stretch bed sheet, so that a considerably greater number of stretch bed sheets can be stacked within a given space, e.g. in a linen shelf. The stretch frame which should preferably consist of metal rods and may be coated with a plastic material, is inexpensive in manufacture and virtually indestructible.

According to the invention the corner portion of the U-shaped frame which is associated with the free end of the spaced short leg should be rounded such it has the shape of an arc, and the free end section of the spaced leg should also extend over a corresponding arc. This arched shape should substantially correspond to the curvature of the corner portions of the stretch bed sheet, so that the corners of the stretch bed sheet, which must be arranged there, are smoothed out and stretched. Of course, the arched end section of the spaced short leg can be rounded further inwardly to exclude any damage to the stretched bed sheet by the free end of the leg.

In the area of their free ends the two long legs may be connected to each other by an additional leg which stabilizes the frame and maintains the parallel position of the long legs. Of course, a plurality of stabilizing legs may be provided as well, the load on the two joints during collapsing being reduced by stabilizing the position of said joints.

Moreover, it is suggested in this invention that the clamping means should comprise a pivotable, spring-actuated stretch lever which clamps the bed sheet between itself and the associated long leg. The arrangement may be chosen such that the stretch lever is moved between an open position aligned with the long leg and a closed position pivoted by 180°. In this way the bed sheet can be fastened quickly and easily and can be detached again.

Since the arrangement in the collapsed end state should take up as little space as possible, the joints should not be arranged exactly at the middle of the long legs, but the leg sections provided with the clamping means should be somewhat shorter than the other sections, namely such that when the frame is collapsed, the shorter sections terminate just before the hairpin-like legs. When the two hairpin-like short legs are spaced apart at a distance of about 20 mm, they are substantially positioned in one plane with the collapsed frame part in the collapsed state of this frame, whereby the arrangement as a whole can be optimally stacked in a virtually perfect level way.

For folding stretch bed sheets which are dimensioned for mattresses of a length of 2000 mm and a width of 900 mm, the associated stretch frame should have legs with a length of about 1000 mm and about 450 mm, respectively. The joints should be arranged such that the longer leg sections have a length of about 520 mm. To be able to fold stretch bed sheets of different sizes, the leg lengths must be dimensioned accordingly.

Alternatively, it is within the scope of the invention to give the legs a telescopic shape, so that a stretch frame for stretch bed sheets of different sizes can be used. Moreover, the stretch frame may be provided with a hook which is expediently mounted on the stabilizing leg, so that the arrangement can e.g. be hung on a rail.

THE DRAWINGS

An embodiment of the invention will now be described briefly with reference to the attached drawing which shows in a purely schematic way in FIG. 1 a front view of the stretch frame in the open state;

FIG. 2 a top view on the stretch frame in the direction of arrow A in FIG. 1; and FIG. 3 a side view of the stretch frame in the direction of arrow B in the open state and in the collapsed state.

DESCRIPTION OF THE PREFERRED EMBODIMENTS

Figure 1:
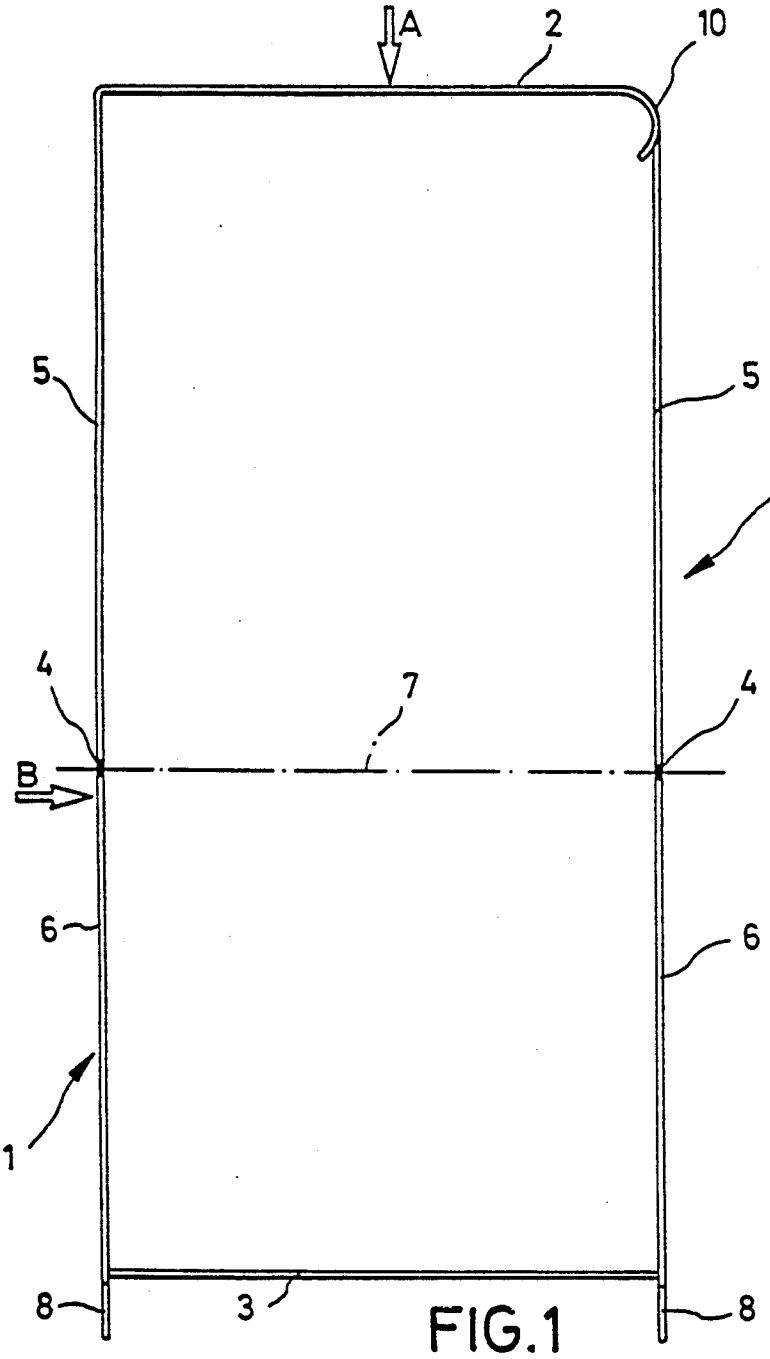

The stretch frame is a frame which is rectangular in top view and comprises two long legs 1 which at their upper ends in FIG. 1 pass into a connection leg 2 and which in the area of their lower end sections are connected by means of a stabilizing leg 3. The long legs 1 are respectively divided by joints 4 into a somewhat longer section 5 and a consequently somewhat shorter section 6. The frame can be collapsed about an axis 7 by virtue of the joints 4. The leg sections 6 are respectively provided with a clamping means 8 at their free ends.

Figure 2:
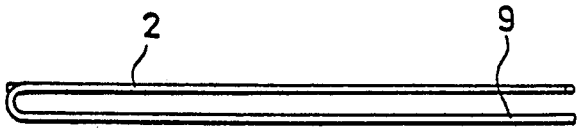

As becomes apparent from FIG. 2, another short leg 9 extends parallel to the connection leg 2 over the entire short side of the frame, the two legs 2 and 9 having a hairpin-like configuration.

In contrast to the left upper frame corner in FIG. 1, the opposite corner 10 is rounded, with the upper leg 9 also extending with its free end section around this corner portion and facing somewhat inwardly with its end to exclude any damage to a stretched bed sheet.

Figure 3:
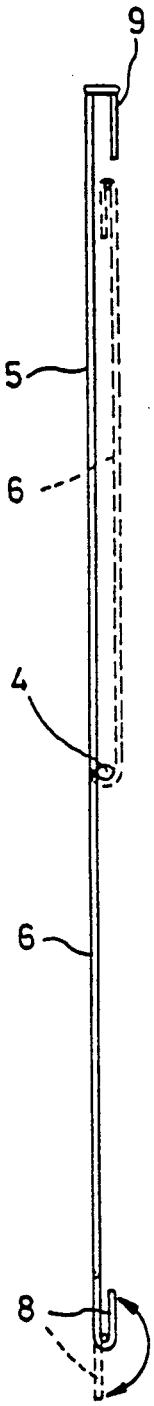

FIG. 3 schematically shows the stretch lever 8 in the open position drawn in broken line and in the clamping position drawn in continuous line. In the latter position the smooth-folded edge of the stretch bed sheet folded once around its transverse center line is pressed against the long legs 1 of the frame. The frame part which is the lower one in the figure is subsequently pivoted about the axis 7 and terminates just before the leg 9, so that these legs are positioned in one plane.

It should be noted that the long legs may respectively be provided with two joints in such a way that the legs can be collapsed about two axes to further reduce the end dimensions of the folded stretch bed sheet.

Alternatively, the legs may be telescopically shaped such that a stretch frame for stretch bed sheets of different sizes can be used. Moreover, the stretch frame may be provided with a hook which is expediently mounted on the stabilizing leg, so that the arrangement can e.g. be hung on a rail.

I claim:

1. A stretch frame for folding and storing a stretch bed sheet, wherein said sheet has a width and contoured elasticized ends and corners, and wherein said sheet is first folded in half forming two ends with a fold line at one end and said contoured corners at the other end, said frame comprising a pair of parallel legs, a shorter leg connecting the parallel legs at one end thereof, said shorter leg having a hairpin-like configuration, said shorter leg having a dimension corresponding to the width of the sheet when the elasticized ends thereof are stretched therearound and connected to the shorter leg, pivot joint means in an intermediate location of each of the parallel legs for conjoint folding of said legs about an axis parallel to said shorter leg, and clamping means at the other end of said parallel legs for detachably securing said bed sheet at said fold line.

2. The stretch frame of claim 1 wherein the short leg and one of the parallel legs define a corner of the frame, and wherein said corner is rounded in the form of an arc to receive the contoured corners of said sheet thereover.

3. The stretch frame of claim 1 wherein an additional shorter leg extends between the parallel legs at the other end thereof.

4. The stretch frame of claim 1 wherein said clamping means comprises a pivotal, spring-actuated stretch lever for clamping the bed sheet against a parallel leg.

5. The stretch frame of claim 1 wherein said pivot joint means divides the frame into two longitudinal portions with one portion being associated with said clamping means and the other portion associated with the shorter leg, said one portion being shorter than the other portion.

6. The stretch frame of claim 1 wherein said parallel legs and said shorter leg comprise metal rods coated with plastic.

* * * * *